US010407885B2

(12) United States Patent
Blum

(10) Patent No.: US 10,407,885 B2
(45) Date of Patent: Sep. 10, 2019

(54) TAP AERATOR COMPRISING A MOUNTING HOUSING

(71) Applicant: NEOPERL GMBH, Müllheim (DE)

(72) Inventor: Gerhard Blum, Gutach (DE)

(73) Assignee: NEOPERL GMBH, Mullheim (DE)

( * ) Notice: Subject to any disclaimer, the term of this patent is extended or adjusted under 35 U.S.C. 154(b) by 664 days.

(21) Appl. No.: 14/772,034

(22) PCT Filed: Feb. 7, 2014

(86) PCT No.: PCT/EP2014/000342
§ 371 (c)(1),
(2) Date: Sep. 1, 2015

(87) PCT Pub. No.: WO2014/135241
PCT Pub. Date: Sep. 12, 2014

(65) Prior Publication Data

US 2016/0017580 A1 Jan. 21, 2016

(30) Foreign Application Priority Data

Mar. 4, 2013 (DE) ..... 20 2013 001 994 U

(51) Int. Cl.
*E03C 1/084* (2006.01)
*E03C 1/086* (2006.01)

(52) U.S. Cl.
CPC ..... *E03C 1/084* (2013.01); *E03C 1/086* (2013.01)

(58) Field of Classification Search
CPC ..... E03C 1/08; E03C 1/084; E03C 1/086
See application file for complete search history.

(56) References Cited

U.S. PATENT DOCUMENTS 4,403,739 A 9/1983 Knapp et al.
5,242,119 A 9/1993 Jariyasunant
2011/0278380 A1* 11/2011 Zoller ..... E03C 1/08 239/601

FOREIGN PATENT DOCUMENTS

DE 102010048701 A1 3/2012
EP 0631020 A1 12/1994

* cited by examiner

*Primary Examiner* — Christopher S Kim
(74) *Attorney, Agent, or Firm* — Volpe and Koenig, P.C.

(57) ABSTRACT

The invention relates to a tap aerator (1) comprising a mounting housing and containing, in said mounting housing (2), an insert part that is designed as a jet divider and diffuser (7) which interacts with a diffuser ring (8). The annular retainer regions (7*a*) and (8*a*) of said diffuser (7) and diffuser ring (8), each arranged on the largest outer circumference, are located, when in a use position, in the interior of the mounting housing (2) at different height positions relative to one another in the axial direction, i.e. the retainer region (7*a*) of the diffuser (7) is not enclosed and the largest outer diameter of the diffuser ring (8) and its retainer region (8*a*) is only as large as, or if required even smaller than, the largest outer diameter of the diffuser (7) and its retainer region (7*a*). This allows the formation of an arrangement which saves space in the radial direction.

6 Claims, 2 Drawing Sheets

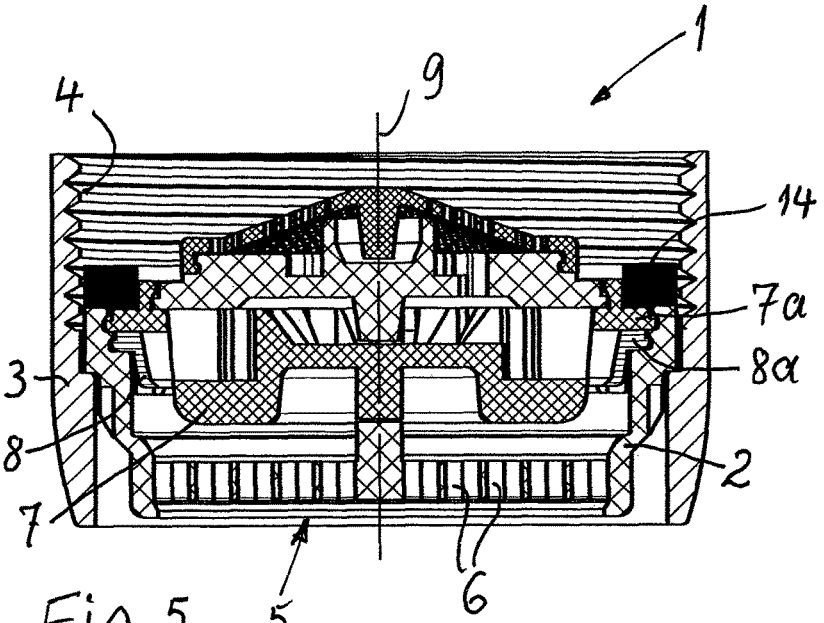
Fig. 5
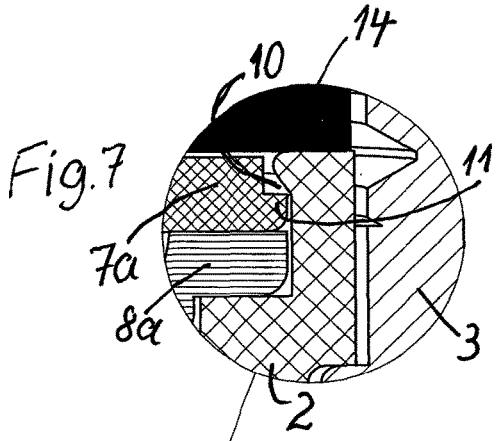
Fig. 7
Fig. 6
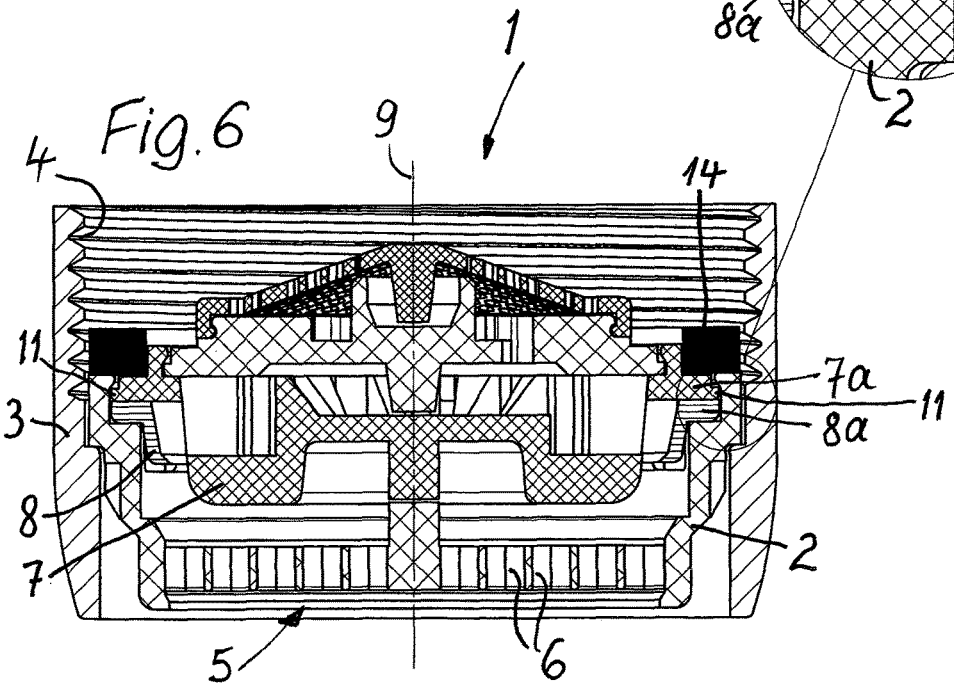

TAP AERATOR COMPRISING A MOUNTING HOUSING

FIELD OF THE INVENTION

The invention relates to a tap aerator having a mounting housing which is mountable on a water outlet of a sanitary outlet fitting by means of a fastening means or fastening ring, wherein the mounting housing has an outflow-side housing end face in particular with throughflow holes and wherein at least one insert part, which is realized as a jet divider, is insertable into the mounting housing and the jet divider is realized as a diffusor which interacts with a diffusor ring, wherein, in each case on their largest outside circumference, the diffusor and the diffusor ring have a ring-shaped holding region, which acts as a holding ring and is arranged at the edge, for their securement in the position of use, wherein the diffusor and the diffusor ring are insertable in each case into the mounting housing up to an insert stop, wherein the holding regions of the diffusor and of the diffusor ring are arranged in the position of use in the mounting housing at different heights and/or diameter planes relative to one another when viewed in the axial direction, wherein the ring-shaped holding regions of the diffusor and of the diffusor ring, which interact as a jet divider by way of their inner regions, are arranged so as to abut against one another in a contacting manner in the axial direction without encompassing or engaging around one another in an edge region, and wherein the largest outside diameter of the diffusor ring and of its holding region is as large as or smaller than the largest outside diameter of the diffusor and of the holding region thereof.

BACKGROUND

A tap aerator with a jet divider which is realized as a diffusor which interacts with a diffusor ring is already previously known from DE 10 2010 048 701 A1.

In the case of said previously known tap aerator, it is provided that the diffusor ring encompasses the diffusor at least in regions on the outside and secures it axially as a result, which allows for a space-saving arrangement in the axial direction and above all produces centering of the diffusor. However, said arrangement requires a relatively large amount of space in the radial direction because the diffusor ring encompasses the ring-shaped holding region of the diffusor on the outside and consequently protrudes in the radial direction.

U.S. Pat. No. 5,242,119 A has already made known a tap aerator with a mounting housing which is mountable on the water outlet of a sanitary outlet fitting by means of a fastening ring which is realized as a sleeve-shaped outlet mouth piece. So that the previously known tap aerator can form a homogeneous and non-spraying water jet, a jet divider, which has to break down inflowing water into a plurality of individual jets, is inserted in its mounting housing. The jet divider is realized for this purpose as a perforated plate which comprises a multitude of throughflow holes which are arranged with respect to one another along a circle. A further perforated plate, which has elongated holes which are oriented in the circumferential direction, and which is separated from the perforated plate serving as a jet divider by means of a metal sieve, is arranged in the direction of flow behind the perforated plate which serves as a jet divider. The two perforated plates and the metal sieve separating them rest on a ring flange which is integrally molded on the inside circumference of a sleeve-shaped housing part. Said inflow-side housing part is inserted into an outflow-side housing part of the mounting housing until a holding region, which is integrally molded on the outer circumference of the inflow-side housing part and serves as a holding ring, rests on the inflow-side end edge of the outflow-side housing part.

U.S. Pat. No. 4,403,739 A has already made known a tap aerator, the mounting housing of which is fastenable on the water outlet of a sanitary outlet fitting by means of a fastening ring. An insert part, which is realized as a jet divider and has to divide and break apart the inflowing water jet into a plurality of individual jets, is insertable into the mounting housing of the previously known tap aerator. The jet divider has a perforated plate which comprises a plurality of throughflow holes which are arranged with respect to one another along a perforated circle. The first perforated plate is placed into an indentation, adapted in shape, of a second perforated plate which also comprises a plurality of throughflow holes which are in alignment with the throughflow holes of the first perforated plate when the two perforated plates are in a relative position, whilst in another relative position said holes only overlap in part and expose a reduced throughflow region. It is true that a holding region which acts as a holding ring can be seen on the second perforated plate—but there is absolutely no component which serves as a diffusor which also has such a holding region which acts as a holding ring, and neither is there a ring-shaped diffusor ring.

EP 0 631 020 A1 has previously made known a tap aerator with a mounting housing which is mountable on the water outlet of a sanitary outlet fitting by means of a fastening ring. Several metal sieves, which are slightly spaced apart from one another and from which the outflow-side metal sieve forms the outlet end face of the tap aerator, are placed into the mounting housing. A perforated plate that serves as a jet divider is placed into the mounting housing on the inflow-side of the metal sieve. The perforated plate that serves as a jet divider does comprise a ring-shaped holding region which acts as a holding ring and is arranged at the edge—beyond the mounting housing and the perforated plate that serves as a jet divider there is, however, no component to be seen that could serve as a ring-shaped diffusor ring with a holding region arranged at the edge.

Consequently, the object is to create a tap aerator of the type defined in the introduction where the diffusor and the diffusor ring are able to interact in the manner known from DE 10 2010 048 701 A1, nevertheless however, for the diffusor ring in the radial direction only as small as possible a radial dimension being required, wherein the diffusor and the diffusor ring are to be secured in the most simple manner in the mounting housing of the tap aerator.

SUMMARY

Said object is achieved according to the invention in that at least the outside edge of the ring-shaped holding region of the diffusor is stepped and the mounting housing comprises an undercut for axially engaging over the radially outwardly protruding step of the diffusor, which step engages in the undercut in a positive locking manner in the position of use.

In the case of the tap aerator according to the invention, the holding regions of the diffusor and of the diffusor ring are arranged in the position of use in the mounting housing at different heights and/or diameter planes relative to one another when viewed in the axial direction, wherein the largest outside diameter of the diffusor ring and of its holding region is as large as or smaller than the largest outside diameter of the diffusor and of the holding region thereof. In this case, the diffusor is arranged so as not to be encompassed by the diffusor ring, i.e. the diffusor ring does not have to be extended in the radial direction so far that it is able to encompass the largest dimension of the diffusor on the outside. Consequently, the arrangement according to the invention produces the possibility of producing the diffusor ring with an outside diameter that is smaller than was necessary for the solution known up to now according to DE 10 2010 048 701 A1, although the diffusor is able to retain its dimension. The overall arrangement can therefore be smaller in size in the radial direction and, in a corresponding manner, can be realized in a space-saving manner on the circumference of the diffusor ring.

The ring-shaped holding regions of the diffusor and of the diffusor ring can be arranged so as to abut against one another so as to contact one another in the position of use. Consequently, as small a dimension as possible in the axial direction can also be achieved and, over and above this, the diffusor and the diffusor ring, with their developments located inside their holding regions, can be realized and interact in such a manner as has already proved its worth in the case of the arrangement according to DE 10 2010 048 701 A1. In this case, according to the invention at least the outside edge of the ring-shaped holding region of the diffusor is stepped and the mounting housing comprises an undercut for axially engaging over the radially outwardly protruding step of the diffusor, which step engages in the undercut in a positive-locking manner in the position of use. Consequently, the diffusor can be secured in a simple manner, in particular in a positive-locking manner, in the mounting housing, although it is independent of the diffusor ring and is not encompassed. Instead of the indirect fastening of the diffusor by means of the diffusor ring, the diffusor itself can be fixed in the mounting housing by means of its holding region.

As part of the diffusor engages in the interior of the diffusor ring for the function as a jet divider, it is particularly favorable—for the assembly also—when the ring-shaped holding region of the diffusor is arranged higher than the ring-shaped holding region of the diffusor ring in the position of use and when the bottom surface of the ring-shaped holding region of the diffusor contacts, in particular in a flat manner, the top surface of the ring-shaped holding region of the diffusor ring. In this way, the diffusor and the diffusor ring pass into a position in which they are able to act efficiently as a jet divider without the holding region of the diffusor ring encompassing or having to encompass the holding region of the diffusor on the outside.

The contact face of the ring-shaped holding region of the diffusor and the contact face of the ring-shaped holding region of the diffusor ring, which is in contact therewith in the position of use, can lie in a plane arranged at right angles to the longitudinal center axis and are themselves realized in a level manner. This simplifies not only their production, but also their assembly, during which they can be placed, in practice, one after another into the mounting housing and "layered", as a result of which their internal regions obtain the reciprocal position that is favorable for jet division.

It is particularly expedient in this case when the diffusor ring, which is introducible into the mounting housing first of all during assembly, is securable in the position of use by the positively fixed diffusor and/or also comprises a stepping which matches an undercut of the mounting housing which interacts with it.

As, according to the invention, the diffusor engages over the diffusor ring in the axial direction, its fastening in the mounting housing can already suffice also to secure the diffusor ring in the position of use thereof. In addition to this or instead of it, however, the diffusor ring can also be fixed in the mounting housing by means a stepping and an undercut, such that both the diffusor and the diffusor ring can possibly be held in each case in the axial direction as a result of undercuts of the mounting housing. Above all in the case of automated mounting operations, it can be achieved in this manner that the diffuser ring, which is already insertable into the mounting housing first of all during assembly, is held in a positive-locking manner before the diffusor is also fastened such that the diffusor ring is not able to move from its position of use in an unwanted manner when being transported between two mounting positions or mounting steps.

The largest radial dimension of the undercut for the diffusor ring can correspond approximately to the smallest diameter of the undercut for the diffusor such that the diffusor ring fits through the somewhat larger opening, provided with an undercut, for the diffusor and can pass into its position of use where, by way of its stepping, it can simply locate or can snap into or latch into the undercut provided for it.

For as simple an assembly as possible, it is advantageous when the positive-locking connection between the diffusor and the mounting housing and/or between the diffusor ring and the mounting housing is a snap connection, the radially snapping protrusion of which is equal to or smaller than the measurement of the elastic flexibility of the housing in the region of the snap connection. When the respective stepping on the outside circumference of the ring-shaped retaining regions is snapped-in, the respective undercut and above all the boundary thereof can yield elastically so far in the radial direction that the corresponding step passes in the axial direction behind or under said undercut which then springs back again into its relaxed position and is able to produce the positive locking connection. This functions particularly well in the case of a mounting housing produced from plastics material, but also in the case of such a housing produced from metal.

Above all in the case of a combination of individual or several of the afore-described features and measures, a tap aerator is produced with a jet divider which is realized as a diffusor and which, in spite of the diffusor ring interacting with the diffusor, can have a relatively small radial dimension because the diffusor is not encompassed and the diffusor ring which interacts with it also extends in the region of its ring-shaped outer retaining region substantially parallel to the retaining region of the diffusor without engaging around or engaging over the same.

BRIEF DESCRIPTION OF THE DRAWINGS

Exemplary embodiments of the invention are described in more detail below by way of the drawing, in which, in partially schematized representations:

FIG. 5 shows a cross section corresponding to FIG. 2, wherein the tap aerator is provided with a fastening ring with an internal thread, by way of which it is mountable on a water outlet, FIG. 6 shows a representation corresponding to FIG. 5, wherein the ring-shaped retaining regions of the diffusor and of the diffusor ring are arranged approximately parallel to one another one on top of another analogous to the representation in FIGS. 2 and 5, but only the retaining region of the diffusor is stepped and fixed in the mounting housing by way of an undercut and, as a result, also secures the diffusor ring in the axial direction, as well as FIG. 7 shows an enlarged representation of said fastening of the outer ring-shaped retaining region of the diffusor ring by means of the ring-shaped retaining region of the diffusor behind the undercut which engages over a stepping of the diffusor.

DETAILED DESCRIPTION OF THE PREFERRED EMBODIMENTS

Figure 4:
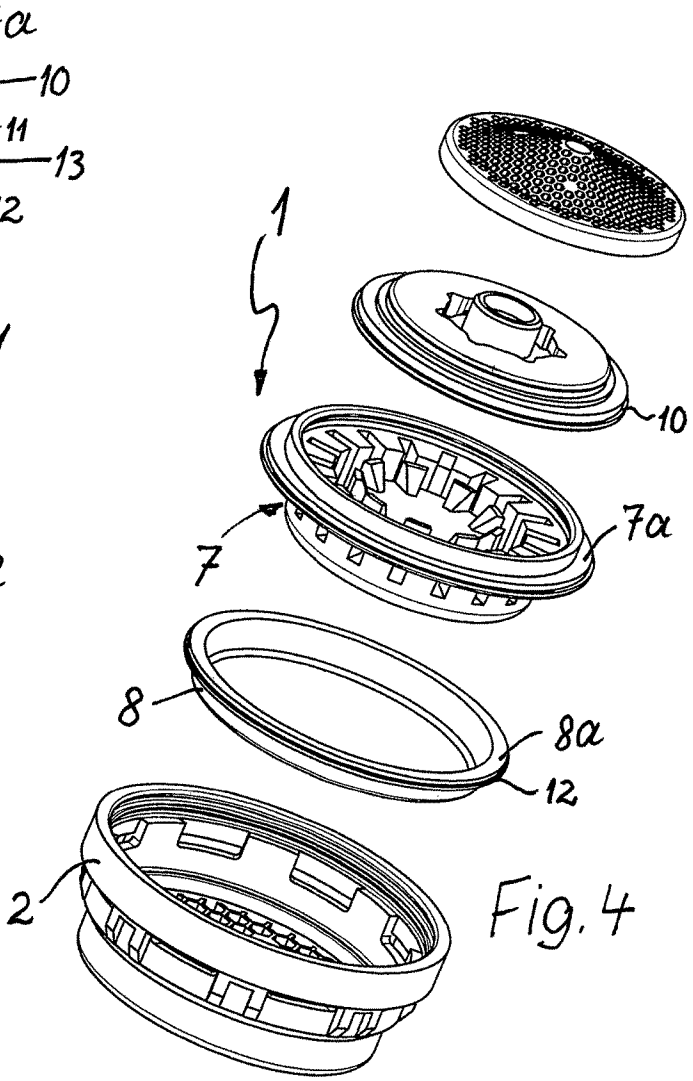
FIG. 4 shows an exploded representation of the tap aerator according to the invention shown in FIGS. 1 and 2, wherein the details shown in an exploded manner are drawn in perspective.

A tap aerator, as a whole represented by 1, comprises a mounting housing 2 which is mountable by means of a fastening means, in the exemplary embodiment by means of a fastening ring 3, on a water outlet of a sanitary outlet fitting. In the two exemplary embodiments according to FIGS. 5 and 6, said fastening ring 3 comprises an internal thread 4 by way of which it is able to be screwed onto the external thread of a water outlet that is not shown in the drawing. In this case, a sealing ring 14 serves for sealing between the water outlet and the tap aerator 1.

The mounting housing 2 comprises a outflow-side housing end face 5 with throughflow holes 6. In the exemplary embodiment, an insert part that is realized as a jet divider is insertable into the mounting housing or in the representation according to FIGS. 5 and 6 is inserted up to an insert stop.

The previously mentioned jet divider, in this case, is realized as a diffusor 7 which interacts with a diffusor ring 8, wherein, in each case on their largest outside circumference, the diffusor 7 and the diffusor ring 8 have a ring-shaped retaining region 7*a* and 8*a*, which acts as a holding ring and is arranged at the edge, for their securement in the position of use.

Figure 3:
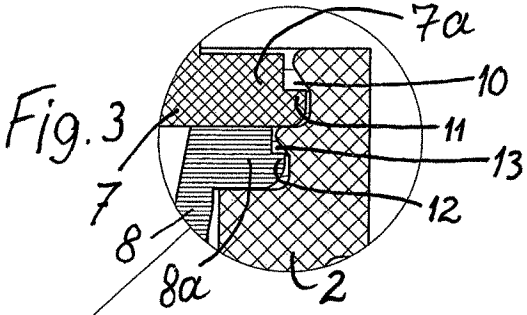
FIG. 3 shows a clearly enlarged representation of the detail marked in a circle in FIG. 2 relating to the ring-shaped outer retaining regions of the diffusor and of the diffusor ring in the position of use or in the mounting position.
Figure 1:
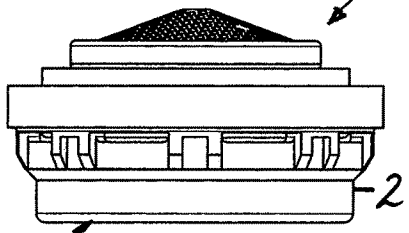
FIG. 1 shows a side view of the tap aerator according to the invention in the orientation which it assumes in its position of use, for example at a water outlet.
Figure 2:
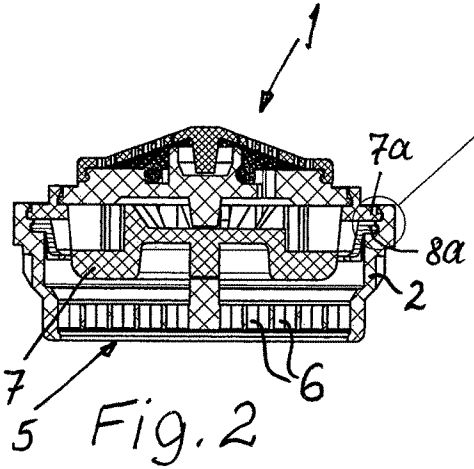
FIG. 2 shows a longitudinal section, arranged in a diameter plane, of the tap aerator according to the invention shown in FIG. 1 with a jet divider which is realized as a diffusor and interacts with a diffusor ring, wherein the diffusor and diffusor ring are arranged one above another and abut against one another in each case by way of their ring-shaped outside retaining region so as not to encompass one another.

It can be seen in FIGS. 2, 5 and 6 and particularly well in FIGS. 3 and 7 that the retaining region 7*a* of the diffusor 7 and the retaining region 8*a* of the diffusor ring 8 are arranged in the position of use in the mounting housing 2 at different heights and diameter planes relative to one another when viewed in the axial direction and that the largest outside diameter of the diffusor ring 8 and of its retaining region 8*a* is as large as (FIGS. 6 and 7) or smaller than the largest outside diameter of the diffusor 7 and of the retaining region (7*a*) thereof (FIGS. 2, 3 and 5). In all cases, however, the outer ring-shaped retaining region of the diffusor 7 is not encompassed and ends directly on the inside surface of the mounting housing 2 without another part region associated with the diffusor 8 coming to rest between it and said mounting housing, as is known from DE 10 2010 048 701 A1. The entire diameter and the outside diameter of the jet divider, which consists of the diffusor 7 and the diffusor ring 8, and consequently of the entire tap aerator 1 can be correspondingly small.

The ring-shaped retaining regions 7*a*, 8*a* of the diffusor 7 and of the diffusor ring 8 are arranged, in this case, so as to contact one another in the axial direction or abut flatly against one another in the position of use in all exemplary embodiments such that, by way of their inner regions, they are able to interact as jet dividers in a correspondingly good manner without encompassing or engaging around one another in the edge region.

In the position of use, the ring-shaped retaining region 7*a* of the diffusor 7 is arranged higher in the axial direction than the ring-shaped retaining region 8*a* of the diffusor ring 8 and the bottom surface of the ring-shaped holding ring 7*a* of the diffusor 7 contacts the top surface of the ring-shaped retaining region 8*a* of the diffusor ring 8 preferably, insofar they overlap, in a flat manner. In this case, the contact side of the ring-shaped retaining region 7*a* of the diffusor 7 and the contact face in contact therewith in the position of use of the ring-shaped retaining region 8*a* of the diffusor ring 8 lie in a plane arranged at right angles to the longitudinal center axis 9. In this case, said contact faces are also realized, in turn, in a level manner in the exemplary embodiments, but could also be realized in a roughened or profiled manner or so as to extend in a conical or inclined manner. The level realization shown in the exemplary embodiments simplifies the production and the assembly.

FIGS. 6 and 7 show that at least the outside edge of the ring-shaped retaining region 7*a* of the diffusor 7 can be stepped and the mounting housing 2 comprises an undercut 10 for engaging axially over the radially outwardly projecting step 11 of the stepped diffusor 7, which step 11 engages in the undercut 10 in a positive locking manner in the position of use according to FIGS. 6 and 7 or comes to rest under the protrusion that forms the undercut. As a result, the diffusor ring 8, which is insertable in the mounting housing first of all during assembly, is secured in its position of use by the positively fixed diffusor 7 and therefore does not necessarily require an own additional fastening.

The exemplary embodiments according to FIGS. 2 to 5 show that the diffusor 8, which is arranged in the position of use under the diffusor 7 and the ring-shaped retaining region 7*a* thereof, can also comprise on its ring-shaped retaining region 8*a* a stepping with a step 12 which protrudes radially in section and matches an undercut 13 of the mounting housing 2 which interacts with it and interacts in the same manner as the undercut 10 with the step 11 of the diffusor 7. As a result, the diffusor ring 8 can already be secured before the diffusor 7 is mounted, which is favorable above all in the case of automated assembly.

It can be seen in the case of the arrangement according to FIGS. 2 to 5 and above all in FIG. 3 that, in this case, the largest radial dimension of the undercut 13 for the diffusor ring 8 and the ring-shaped retaining region 8*a* thereof correspond approximately to the smallest diameter of the undercut 10 for the diffusor 7 and the stepped ring-shaped retaining region 7*a* thereof such that the step 12 on the ring-shaped retaining region 8*a* is able to be easily introduced through said opening, which is higher in the position of use, with the undercut 10 and is not obstructed by the protrusion beyond the actual undercut 10.

The positive-locking connection between the diffusor 7 and the mounting housing 2 as well as between the diffusor ring 8 and the mounting housing 2 can be a snap connection, an embodiment being shown in FIGS. 6 and 7 where such a snap connection is present only between the diffusor ring 7 and the mounting housing 2. In the case of said snap connections, the protrusion which snaps in radially above the respective step 11 and 12 is equal to or smaller than the measurement of the elastic flexibility of the mounting housing 2 in the region of said snap connections such that no additional measures such as retaining screws or the like are required for producing the positive locking connection in the position of use. Such a snap connection can be realized in a particularly simple manner when at least the mounting housing 2 consists of plastics material, however an embodiment of the mounting housing 2 produced from metal is also possible as metal also allows for a certain elastic deformation where the deformed region returns—elastically—back into its position after the deforming and loading process.

The tap aerator 1 with a mounting housing includes in said mounting housing 2 an insert part which is realized as a jet divider and is realized as a diffusor 7 which interacts with a diffusor ring 8. The retaining regions 7*a* and 8*a* of the diffusor 7 and of the diffusor ring 8, said retaining regions being arranged in each case on the largest outside circumference, are arranged, in this case, at different heights in the axial direction relative to one another in the interior of the mounting housing 2 in the position of use, i.e. the retaining region 7*a* of the diffusor 7 is not encompassed and the largest outside diameter of the diffusor ring 8 and of its retaining region 8*a* is only as large as or, where applicable, even smaller than the largest outside diameter of the diffusor 7 and of the retaining region 7*a* thereof such that an arrangement which is space-saving in the radial direction is formed.

The invention claimed is:

1. A tap aerator (1) having a mounting housing (2) which is mountable on a water outlet of a sanitary outlet fitting by a fastening ring (3), wherein the mounting housing (2) has an outflow-side housing end face (5) with throughflow holes (6) and wherein at least one insert part, which is configured as a jet divider, is insertable into the mounting housing (2) and the jet divider is configured as a diffusor (7) which interacts with a diffusor ring (8), wherein, respectively on a largest outside circumference thereof, the diffusor (7) and the diffusor ring (8) have a ring-shaped holding region (7*a*, 8*a*), which acts as a holding ring and is arranged at an edge, for securement in a position of use, wherein the diffusor (7) and the diffusor ring (8) are insertable, respectively, into the mounting housing up to an insert stop, wherein the holding regions (7*a*, 8*a*) of the diffusor (7) and of the diffusor ring (8) are arranged in the position of use in the mounting housing (2) at different heights and/or diameter planes relative to one another when viewed in an axial direction, wherein the ring-shaped holding regions (7*a*, 8*a*) of the diffusor (7) and of the diffusor ring (8), which interact as a jet divider by way of inner regions thereof, are arranged so as to abut against one another in a contacting manner in the axial direction without encompassing or engaging around one another in an edge region and wherein the largest outside diameter of the diffusor ring (8) and of its holding region (8*a*) is as large as or smaller than the largest outside diameter of the diffusor (7) and of the holding region (7*a*) thereof, at least an outside edge of the ring-shaped holding region (7*a*) of the diffusor (7) is stepped and the mounting housing (2) comprises an undercut (10) for axially engaging over the radially outwardly protruding step (11) of the diffusor (7), said step (11) engages in the undercut (10) in a positive-locking manner in the position of use.

2. The tap aerator as claimed in claim 1, wherein the ring-shaped holding region (7*a*) of the diffusor (7) is arranged higher than the ring-shaped holding region (8*a*) of the diffusor ring (8) in the position of use and the bottom surface of the ring-shaped holding ring (7*a*) of the diffusor (7) contacts, in a flat manner, the top surface of the ring-shaped holding region (8*a*) of the diffusor ring (8).

3. The tap aerator as claimed in claim 1, wherein a contact face of the ring-shaped holding region (7*a*) of the diffusor (7) and a contact face of the ring-shaped holding region (8*a*) of the diffusor ring (8), which is in contact therewith in the position of use, lie in a plane arranged at right angles to a longitudinal center axis (9) and are themselves realized in a level manner.

4. The tap aerator as claimed in claim 1, wherein the diffusor ring (8), which is introducible into the mounting housing (2) during assembly, is securable in the position of use by the positively fixed diffusor (7) and/or also comprises a stepping which matches an undercut (13) of the mounting housing (2) which interacts with it.

5. The tap aerator as claimed in claim 4, wherein the largest radial dimension of the undercut (13) for the diffusor ring (8) generally corresponds to the smallest diameter of the undercut (10) for the diffusor.

6. The tap aerator as claimed in claim 1, wherein the positive-locking connection between the diffusor and the mounting housing and/or between the diffusor ring and the mounting housing is a snap connection, the radially snapping protrusion of which is equal to or smaller than the measurement of an elastic flexibility of the mounting housing (2) in the region of the snap connection.

* * * * *